US010851649B2

(12) United States Patent
Shields et al.

(10) Patent No.: US 10,851,649 B2
(45) Date of Patent: Dec. 1, 2020

(54) HIGH WALL MINING CUTTING HEAD AND SUPPORT

(71) Applicants: Randy C. Shields, Mt Hope, WV (US); Winfred Lee Shrewsbury, Athens, WV (US)

(72) Inventors: Randy C. Shields, Mt Hope, WV (US); Winfred Lee Shrewsbury, Athens, WV (US)

( * ) Notice: Subject to any disclaimer, the term of this patent is extended or adjusted under 35 U.S.C. 154(b) by 0 days.

(21) Appl. No.: 15/829,852

(22) Filed: Dec. 1, 2017

(65) Prior Publication Data

US 2018/0195385 A1 Jul. 12, 2018

Related U.S. Application Data

(60) Provisional application No. 62/429,062, filed on Dec. 1, 2016.

(51) Int. Cl.
*E21C 27/00* (2006.01)
*E21C 27/24* (2006.01)

(52) U.S. Cl.
CPC ..... *E21C 27/24* (2013.01)

(58) Field of Classification Search
CPC ..... E21C 27/24
See application file for complete search history.

(56) References Cited

U.S. PATENT DOCUMENTS 4,014,574 A * 3/1977 Todd ..... E21C 27/24 175/61
4,310,199 A * 1/1982 Freed, Jr. ..... E21C 25/10 299/76

* cited by examiner

*Primary Examiner* — Janine M Kreck
(74) *Attorney, Agent, or Firm* — Jonathan Brown

(57) ABSTRACT

A cutting head and support arms for mining, for example, for high wall mining, provides a modular design and includes a pair of support arms, a head shaft extending between and outside of each of the support arms, a central and outer drums about the head shaft, and a set of removable struts attached between the support arms. The struts can be removed so that the support arms can be separated for easier access to the drums and head shaft and other components. Further, the support arms are of several laminate layers, which can be separated for ready maintenance, particularly for components at or near the outside ends of the cutting head and support arms, or within or about the support arms.

20 Claims, 8 Drawing Sheets

HIGH WALL MINING CUTTING HEAD AND SUPPORT

CROSS REFERENCE TO RELATED APPLICATION(S)

This application claims the benefit of, U.S. Provisional Application No. 62/429,062 entitled "HIGH WALL MINING CUTTING HEAD AND SUPPORT," filed on Dec. 1, 2016, the subject matter of which is hereby incorporated therein by reference in its entirety.

TECHNICAL FIELD OF THE INVENTION

The present invention relates to mining equipment, and more specifically to a cutting head and support arms for mining operations, such as, for example, high wall mining.

BACKGROUND OF THE INVENTION

Highwall mining is a method of extracting coal or other mineral from a seam with greater efficiency and less damage to land surface than a number of other conventional mining methods such as strip mining. A "highwall" is a vertical or nearly vertical wall with an exposed seam or seams, typically from mining cut into the side of a mountain or from the digging of a pit for another type of mining. The seam or seams typically extend into the earth from the exposed surface area along the highwall. Rather than miners going into the seam, which is labor-intensive and dangerous, machinery with a control unit is typically brought to the seam, with a cutting head and apparatus that extends into the seam.

Highwall mining is also effective at working seams that are thin, sometimes as little as two or three feet thick. Highwall mining is often effective at removing coal and minerals from seams that cannot be economically removed by other methods. Portions of the seam sufficient to leave adequate structural support are extracted with the cutting head and apparatus. The coal or material are brought out of the seam, often by open conveyor vehicles or equipment for this purpose, the coal removed to the surface and taken away.

As with any kind of mining, the object is generally to extract the maximum amount with the lowest cost and greatest efficiency possible. High wall mining is a step towards these objectives but can present some challenges. The efficiency of extraction from a seam is often directly related to how much of the time the high wall mining machinery is in operation. The more a machine is down for maintenance or repair, the less that is being mined, which lowers operational efficiency. Generally, a cutting head extends into the seam and the end of, and supported by, a pair of supporting arms. The cutting head generally has a spinning shaft between the supporting arms, and a drum set, holding a bit set, around the shaft Two particularly sensitive maintenance points of such machinery are often the bearings that enable the drum assembly to spin about the shaft, and the gears that operate the drums. Because these parts are moving and under use pressure, they are more prone to wear.

A scenario that is particularly likely is the bearings of the cutting head overheating and burning themselves out, destroying the surrounding assembly they are designed to protect. Because the cutting head, by nature of the machinery, operates some distance under the ground and away from the operator, it can be difficult for an operator to hear or notice bearings that need to be changed until the bearings have burned out. When this occurs, the cutting head assembly, as mentioned for other repairs, usually needs to be disassembled to make repairs.

Typically, the supporting arm assembly is a single-piece construction. Because the shaft and consequently, drum assembly, are held by, and between, the supporting arms, removing the shaft, drums, or portions of the drum assembly from the supporting arms, for example when maintenance or repair of bearings, gears or other parts can be difficult. Typically, the drum assembly has to be disassembled from the shaft and the shaft pulled from the supporting arms with hydraulic means. In other words, because the supporting arms are fixed, the shaft and drum assembly are typically taken apart to remove it from the supporting arms.

A secondary maintenance problem is that the gear assembly, and often the bearing carrier holding the bearings, is typically located within the drum assembly, usually inside the supporting arms, so that the drum or drums must often also be torn apart to get at such internal components. The drums typically must be a multi-piece construction for removal and maintenance purposes. Further, a pinion is typically located within each respective arm near the shaft to help drive it. Because each pinion is seated within the internal part of a supporting arm, removing it for maintenance is very difficult. This can be particularly true if the pinion has become damaged or disfigured. Such maintenance can take up to several days, during which time the machinery is inactive and the seam is not being mined.

What is needed is a system that addresses these issue, providing a way to more easily and quickly repair and maintain cutting head machinery and reduce machine downtime.

SUMMARY

A high wall mining cutting head and support is with modular design is disclosed. The cutting head and support arm device, is generally comprised of at least one, and in a preferred embodiment, a pair of support arms and a Gutting head apparatus, The cutting head apparatus is comprised generally of a central drum set between the support arms, a set of outer drums, outside each of the respective support arms, and a head shaft running within and through the central one-piece drum and outer drums, in a generally coaxial relationship.

The central and outer drums each contain oil for lubrication, forming an oil reservoir. Head shaft bearings surrounding the head shaft generally assist the head shaft in turning. A suitable bearing carrying and holding arrangement is provided for this purpose.

The support arms are comprised of laminate layers, herein comprised of a support arm outer lamination layer support arm center lamination layer, and a support arm inner lamination layer. The laminate layers, are joined by a laminate attachment apparatus which can be comprised of any suitable means in the art which can be reversibly un-joined, such as, e.g., metal dowels, bolts or screws, in a preferred embodiment, the laminate layers, are dowel pinned for alignment and bolted together Cutting bits, represented herein as are present in a suitable pattern for cutting on the exterior of the central and outer drums. In a preferred embodiment, the bits are arranged in an advantageous pattern that assists with a first maintenance issue. In this embodiment, the bits are in a "double vee" pattern. With this bit pattern, if a first bit fails, the cutting will simply fail upon the second bit.

A primary mechanical problem, the difficulty of removing and maintaining cutting head components such as bearings carriers and bearings is addressed by the modular support arms, which are capable of easy disassembly. Removable struts are provided. The struts lie between the respective support arms, at designated intervals.

The struts are removably attached to the support arms at suitable locations along the support arms.

When access to the head shaft and related components is necessary, the struts can be quickly removed from the support arms. The outer drums can them be removed from the outside and the support arms, and pulled outward, thereby separating the support arms, from the head shaft and central drum assembly. In this way, the difficulty of removing these components from a fixed carrier arm assembly is addressed.

Further, when the laminate attachment apparatus is detached, the support arm, the respective laminate layers detach from each other and can be relatively easily pulled apart from each other. Access to components about or integrated within the support arm, such as the bearing carriers and mechanical drive mechanism, which is within and about the support arm, including a number of components to be discussed shortly, is made much more convenient. With the layers apart, barriers to a number of components of the mechanical drive, particularly those located at or near the center laminate are removed.

Further, since outer components such as the outer drum head or outer laminate layer of the support arms, can be pulled out or removed, access to components such as those of the drive mechanism can be obtained without having to go through the difficult process of pulling the head shaft or central drum. The bearing carrier, bearings, and other gear components can be removed outwardly to be changed or serviced without further disassembly of the center drum or removal of the shaft.

Through this inventive apparatus, the task of removing the head shaft and central drum assembly from the fixed support arms and completing maintenance and repair, which could take several days can take as little as a few hours with the present apparatus, greatly reducing down time and increasing efficiency.

Another innovation of the invention herein for increasing efficiency and reducing maintenance is additionally present. A portion of layers of each support arm can be milled, pre-fabricated, or otherwise evacuated on either side of the support arm, to provide a set of hit clearance trenches.

Core breaker bits can then be provided at or near the support arm. The core breaker bits can move through the bit clearance trenches and because of this, can operate within the frontal space of the support arms, doing breaking work around the support arms, themselves. The horizontal bit space is about 2½ inches and is advantageously maintained across the support arms, representing a great increase in breaking seam around the support arms area.

The core breaker bits can be further modified for their purpose. For example, in a preferred embodiment, the core breaker bits are flattened and pinned to mounts to maintain a set and minimal clearance from the support arms.

BRIEF DESCRIPTION OF THE DRAWINGS

The detailed description particularly refers to the accompanying figures in which.

DETAILED DESCRIPTION OF PREFERRED EMBODIMENTS

Figure 1A:
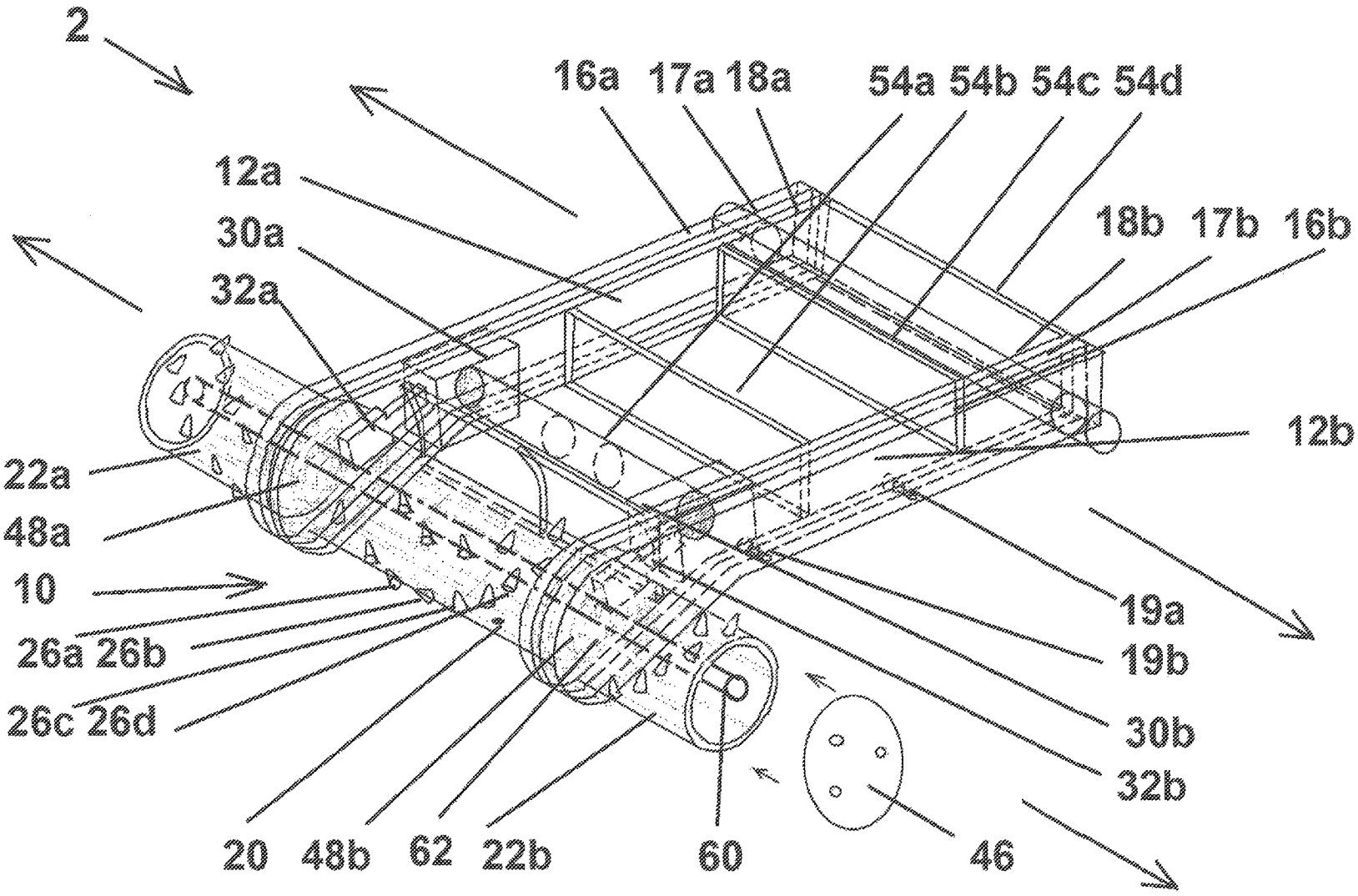
FIG. 1A is a front, top perspective views of an illustrative embodiment of a cutting head and support arms according to the present invention.

Other objects, features and advantages of the invention will become apparent from a consideration of the following detailed description and the accompanying drawings. The following descriptions are made referring to the figures, wherein like reference numbers refer to like features throughout this description. Not all numbers appearing in one figure are necessarily present in another.

For the purposes of promoting and understanding the principals of the invention, reference will now be made to one or more illustrative embodiments. The cutting head and support apparatus herein 2 of the present invention may comprise one or more of the following features and combinations thereof as described here Turning to FIGS. 1A-1E general, and more specifically to FIG. 1A, an embodiment of a modular design cutting head and support arms for mining, for example, for high wall mining, is depicted. The cutting head and support arm device 2, is generally comprised of at least one, and in this embodiment, a pair of support arms 12*a*, 12*b* and a cutting head apparatus 10, The cutting head apparatus 10 is comprised generally of a central drum 20 set between the support arms 12*a*, 12*b* (a one-piece drum in this embodiment), a set of outer drums 22*a*, 22*b* outside each of the respective support arms 12*a*, 12*b*, and a head shaft 60 running within and through the central one-piece drum 20 and outer drums 22*a*, 22*b* in a generally coaxial relationship. The head shaft 60 supports the central drum 20 and outer drums 22*a*, 22*b* of the cutting head 10 apparatus, the head shaft 60 passing through each. In this embodiment, the central drum 20 is if a generally single-piece construction.

An outer drum head 46 or end plate is placed at each respective end of each of the outer drums 22*a*, 22*b* (the second outer drum not visible in this figure), at the end of the head shaft 60, to secure the apparatus within the drums 22*a*, 22*b*. The outer drum head in this embodiment, for example, is bolted to a flange inside the outer drum and bolted centrally to the end of the head shaft 60.

The central and outer drums 20, 22*a*, 22*b* each contain oil for lubrication, forming an oil reservoir. Head shaft bearings 62 surrounding the head shaft 60 generally where the head shaft 60 is held by the support arms 12*a*, 12*b*, and in this embodiment located on each side of each respective support arm 12*a*, 12*b*, assist the head shaft 62 in turning. A suitable bearing carrying and holding arrangement 48*a*, 48*b* is provided for this purpose, such as, as in this embodiment, a two-piece bearing carrier/holder (e.g. a double roller circle) 48 with cat seal bearing/holder for sealing oil.

The head shaft 60, in relation to the support arms 12*a*, 12*b*, extends between and outside of each of the support arms 12*a*, 12*b*. The support arms 12*a*, 12*b* each support a hydraulic motor (not shown) and drive shaft 32*a*, 32*b* to drive the head shaft 60 and thereby drive the cutting head 10. A drive mechanism, represented as 30, 30A operating in connection to, and along the support arms 12*a*, 12*b* is comprised of suitable means known in the art for this purpose.

It is noted that some interactive drive components will be described, some drive components or full arrangement of components between the motor(s) and head shaft 60 may not be depicted or described in full detail for simplicity.

The support arms 12*a*, 12*b* are comprised of at least two joined laminate layers, which in this embodiment comprise three respective laminate layers, herein comprised of a support arm outer lamination layer 16A, 16B, support arm center lamination layer 17A, 17B, and a support arm inner lamination layer 18A, 18B. The laminate layers, 16A, 17A, 18A, 18B, 17B, 18B, are joined by a laminate attachment apparatus, represented herein as 19A and 19B (and shown on one side of this figure), which can be comprised of any suitable means in the art which can be reversibly un-joined, such as, e.g., metal dowels, bolts or screws, in this embodiment, the laminate layers, 16A, 17A, 18A, 16B, 17B, 18B are dowel pinned for alignment and bolted together Cutting bits, represented herein as 26*a*, 26*b*, 26*c*, 26*d* are present in a suitable pattern for cutting on the exterior of the central and outer drums 20, 22*a*, 22*b*. Herein, the bits are arranged in an advantageous pattern that assists with a first maintenance issue. Often, if a single or few bits cease functioning, a situation is created wherein that part of the cutting head is ramming directly into the seam ahead of it. This can slow or stop cutting, or if the cutting head proceeds, may quickly create extra wear on other bits. This can lead to other bits failing, or bearings or other components burning out. In this embodiment, the bits are in a "double vee" pattern. With this bit pattern, if a first bit fails, the cutting will simply fall upon the second bit. This innovation leads to longer life for the overall bit set, and fewer mechanical breakdowns due to problems relating to failing individual bits.

A primary mechanical problem, the difficulty of removing and maintaining cutting head 10 components such as bearings carriers 48*a*, 48*b* and bearings 62 is addressed by the modular support arms 12*a*, 12*b*, which are capable of easy disassembly. Removable struts or cross-braces (herein "struts", represented herein as 54*a*, 54*b*, 54*c*, 54*d* are provided. The struts 54*a*, 54*b*, 54*c*, 54*d* lie between the respective support arms 12*a*, 12*b* at designated intervals and serve to maintain a constant distance between the support arms 12*a*, 12*b* spacing and securing the support arms 12*a*, 12*b* relative to one another.

The struts 54*a*, 54*b*, 54*c*, 54*d* are removably attached to the support arms 12*a*, 12*b* by any suitable means in the art for making such attachments such as, e.g., bolts, dowels or screws, and attached at suitable locations along the support arms 12*a*, 12*b*. In this embodiment, the struts 54*a*, 54*b*, 54*c*, 54*d* are each bolted to the respective support arm center laminate layers 17A, 17B. A top and/or bottom cover (not shown) can also be provided and secured to the are of the support arms 12*a*, 12*b* and struts 54*a*, 54*b*, 54*c*, 54*d* to provide additional structural support and protection.

When access to the head shaft 60 and related components is necessary, the struts 54*a*, 54*b*, 54*c*, 54*d* can be quickly removed from the support arms 12*a*, 12*b*. As shown by arrows, the outer drums 22*a*, 22*b*, can them be removed from the outside and the support arms 12*a*, 12*b*, and pulled outward, thereby separating the support arms 12*a*, 12*b* from the head shaft 60 and central drum 20 assembly. In this way, the difficulty of removing these components from a fixed carrier arm assembly is addressed.

Figure 1B:
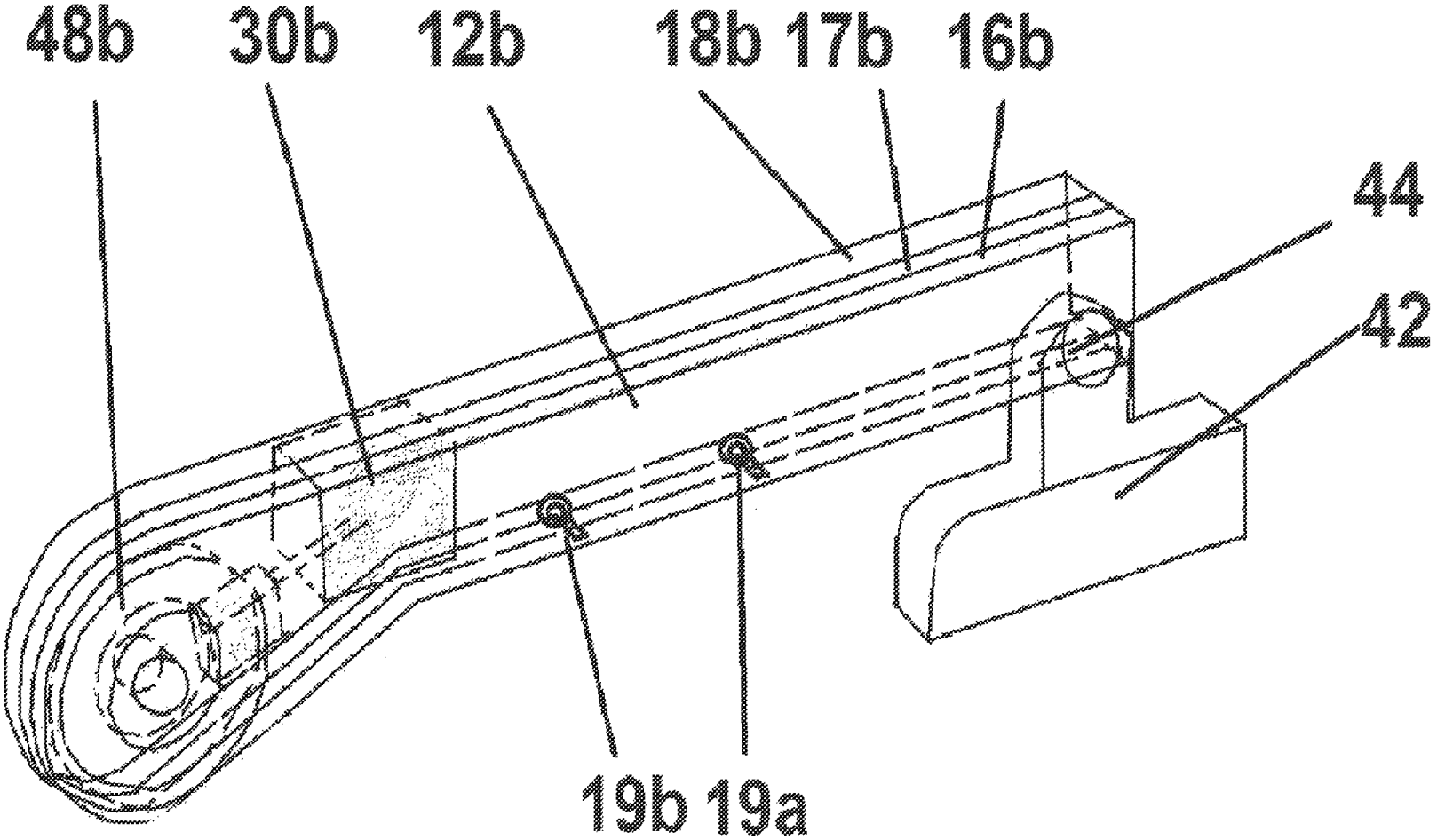
FIG. 1B is a front, top perspective views of a support arm of the embodiment of FIG. 1A depicting further features of the arms

Turning additionally to FIG. 1B, maintenance and repair are further simplified through use of the advantageous laminate layer design of the support arms 12*a*, 12*b*. In FIG. 1B, a single support arm 12*b* is shown. When the laminate attachment apparatus 19*a*, 19*b* is detached, the support arm 12B, the respective laminate layers 16B, 17B, 18B detach from each other and can be relatively easily pulled apart from each other. Access to components about or integrated within the support arm 12*b*, such as the bearing carriers 48*b* and mechanical drive mechanism 30, which is within and about the support arm 12*b*, including a number of components to be discussed shortly, is made much more convenient. With the layers apart, barriers to a number of components of the mechanical drive 30, particularly those located at or near the center laminate 17B, are removed.

Further, since outer components such as the outer drum head 46 or outer laminate layer 16A, 16B of the support arms 12*a*, 12*b* can be pulled out or removed, access to components such as those of the drive mechanism 30 can be obtained without having to go through the difficult process of pulling the head shaft 60 or central drum 20. The bearing carrier, bearings, and other gear components can be removed outwardly to be changed or serviced without further disassembly of the center drum 20 or removal of the shaft 14.

Through this inventive apparatus, the task of removing the head shaft 60 and central drum assembly 20 from the fixed support arms and completing maintenance and repair, which could, as noted previously, take several days can take as little as a few hours with the present apparatus, greatly reducing down time and increasing efficiency.

Each support arm 12*a*, 12*b*, is further comprised of a hydraulic cylinder and 42 at least one hinge 44 to help pivot each respective support arm 12*a*, 12*b*, up and down during operation as necessary, and maintenance of this may be simplified as well.

Figure 1C:
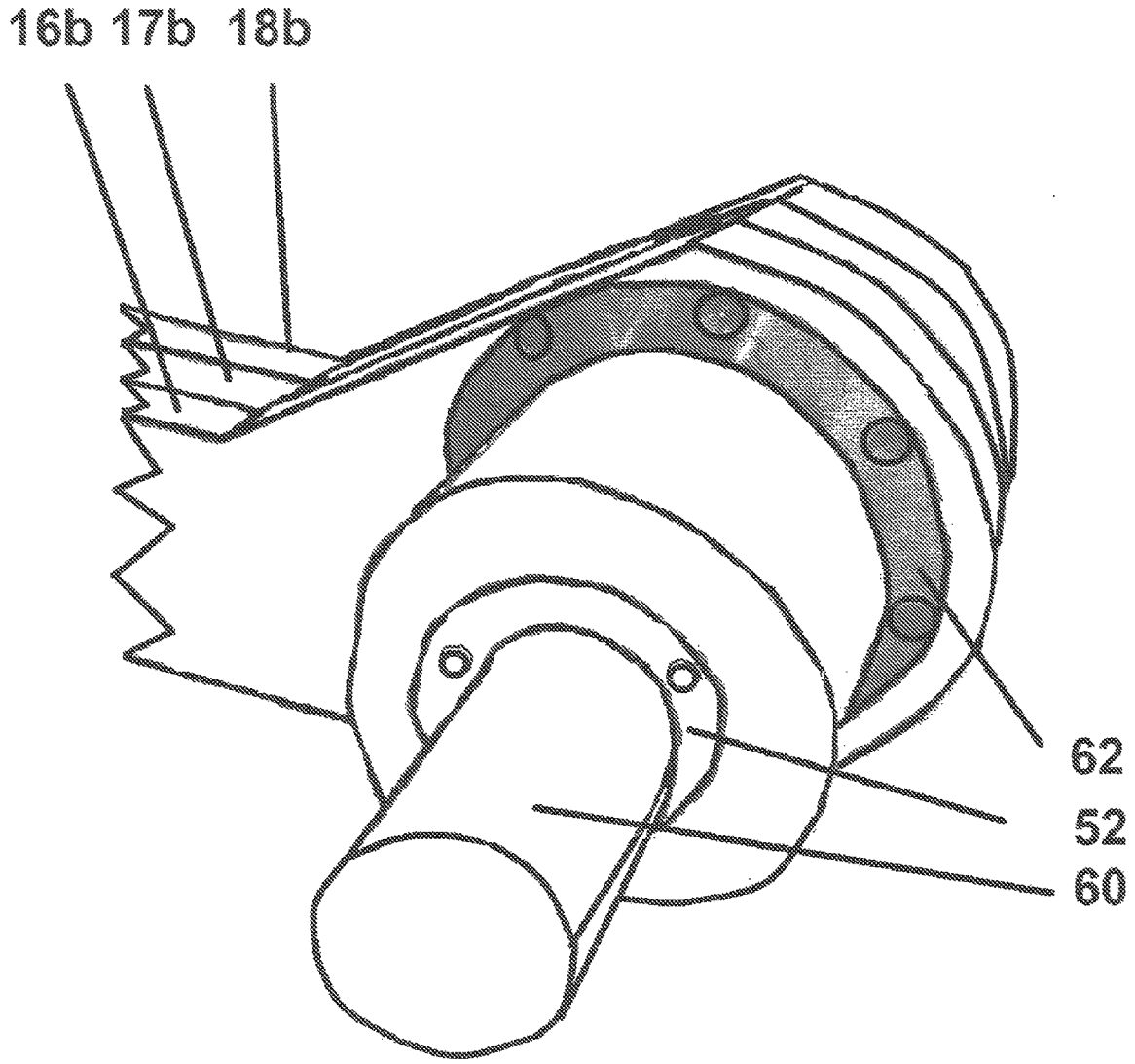
FIG. 1C is a perspective views of a portion of the cutting head and support arms of the embodiment of FIG. 1A.

Turning additionally to FIG. 1C, a portion of a support arm 12*b* with the outer drum 22*b* removed is shown. The head shaft bearings 62 are shown about the head shaft 60. The head shaft 60 is attached to the drums 20, 22*a*, 22*b* by any suitable means known in the art. In this embodiment, keyless coupling apparatus 52, as known in the art, fixes the central drum 20, and may fix the outer drums 22*a*, 22*b*, to the head shaft 60.

Figure 1D:
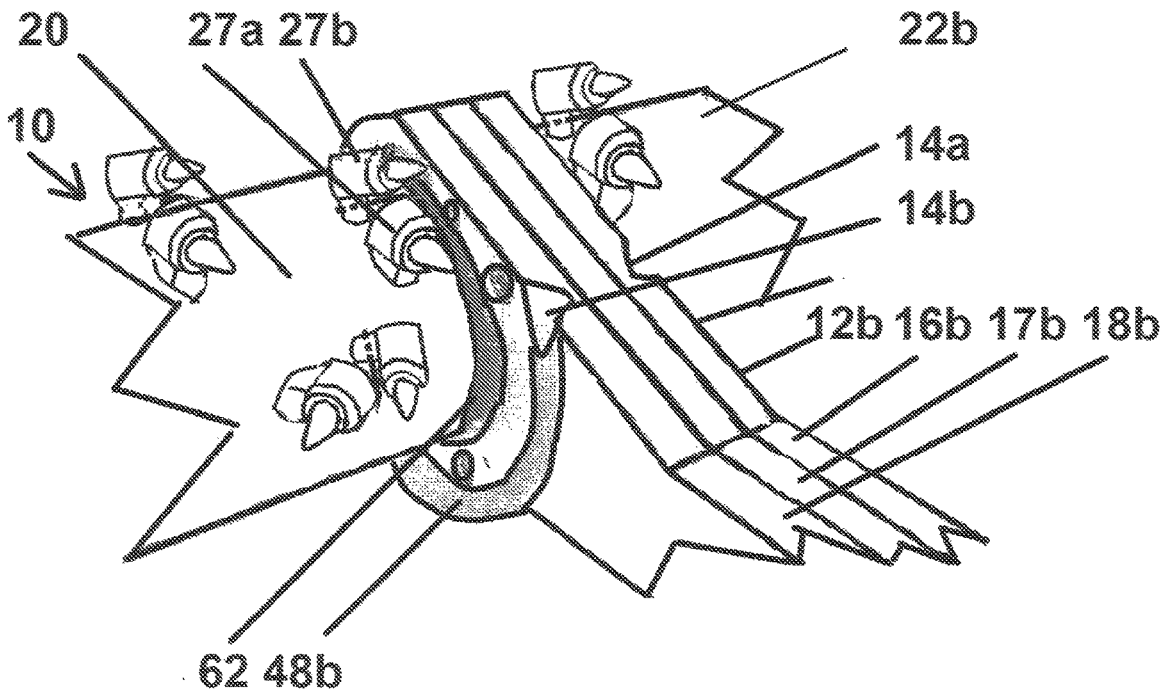
FIG. 1D is a perspective view of a portion of the cutting head assembly of the embodiment of FIG. 1A.

Turning to FIG. 1D, another innovation of the invention herein for increasing efficiency and reducing maintenance is shown. During mining, because there are no rotating or spinning bits in the area of the front of the support arms 12*a*, 12*b*, a situation results in which the area before the support arms 12*a*, 12*b* is not being broken up. This can lead to the support arms ramming a more solid portion of a seam immediately before it. This can result in greater damage to the arms, burning out of components like bearings 62, or other repair issues. A portion of layers of each support arm 12*b* can be milled, prefabricated, or otherwise evacuated on either side of the support arm 12*a*, 12*b* to provide a set of bit clearance trenches 14*a*, 14*b*.

Core breaker bits, represented herein as 27*a*, 27*b*, can now be provided at or near the support arm 12*b*. The core breaker bits 27*a*, 27*b* can move through the bit clearance trenches 14*a*, 14*b* and because of this, can operate within the frontal space of the support arms 12*a*, 12*b*, doing breaking work around the support arms 12*a*, 12*b* themselves. The horizontal bit space is about 2½ inches and is advantageously maintained across the support arms, representing a great increase in breaking seam around the support arms area.

The core breaker bits 27*a*, 27*b*, as is the case for the regular bits 26*a*, 26*b*, 26*c*, 26*d*, can be attached to the drums 20, 22*a*, 22*b*, by any suitable means, such as, e.g., by mounting and may be pinned or otherwise attached to mounts. The core breaker bits 27*a*, 27*b* can be further modified for their purpose. For example, in this embodiment the bits are flattened and pinned to mounts to maintain a set and minimal clearance from the support arms.

Figure 1E:
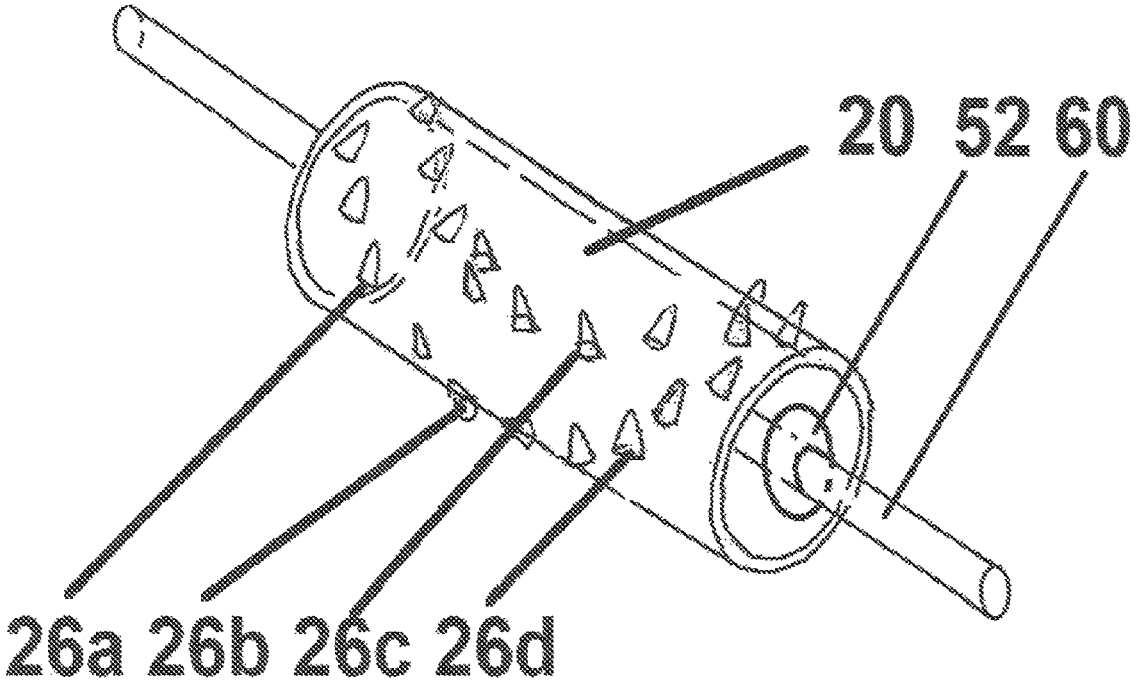
FIG. 1E is a perspective view of the central drum and head shaft assembly of the embodiment of FIG. 1A.

The regular bits 26*a*, 26*b*, 26*c*, 26*d*, by contrast, are generally rounded, as in this embodiment, and mounted to allow slight spring resisted axial movement Referring to FIG. 1*e* the central drum 20 and head shaft assembly is shown removed from the remainder of the cutting head 10. As can be seen clearly, the bit pattern on the central drum, referred to earlier, generally form two Vees around the diameter of the drum 20, each Vee extending the full width of the central drum. The Vee pattern funnels the coal toward the center of the drum 20 during cutting operation to minimize loss of loose coal to the side as the coal is conveyed away. Additionally, it can be more readily seen with this view that by providing a pair of the bit patterns around the diameter ensures that if one bit in the first pattern breaks at any particular point along the width of the drum 20, a second bit is available at or proximate to the same point along the width in the second pattern.

Figure 2A:
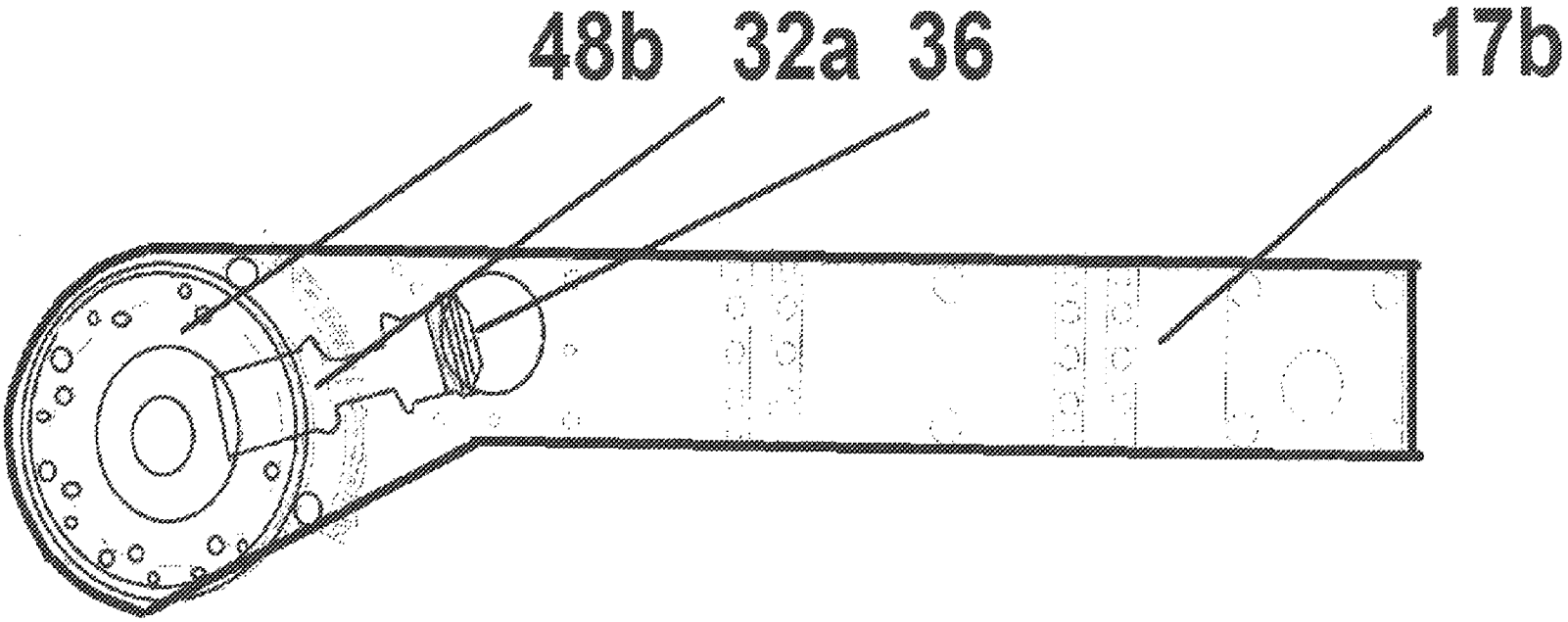
FIG. 2A is a side view of the center layer of the illustrative support arms of the embodiment of FIG. 1A.
Figure 2B:
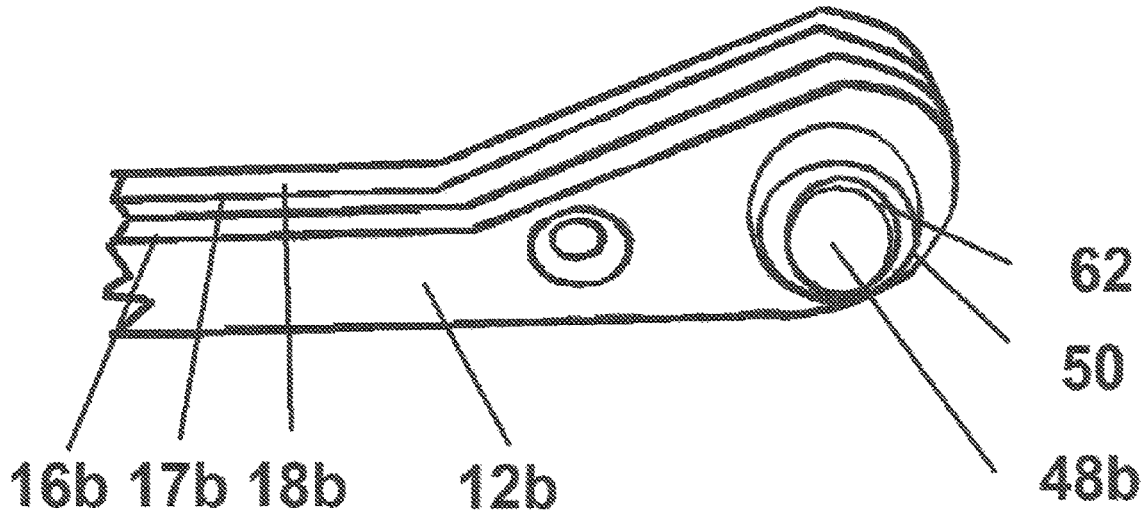
FIG. 2B is a side perspective view depicting a carrier arm and carrier bearing assembly of the embodiment of FIG. 1A.
Figure 2C:
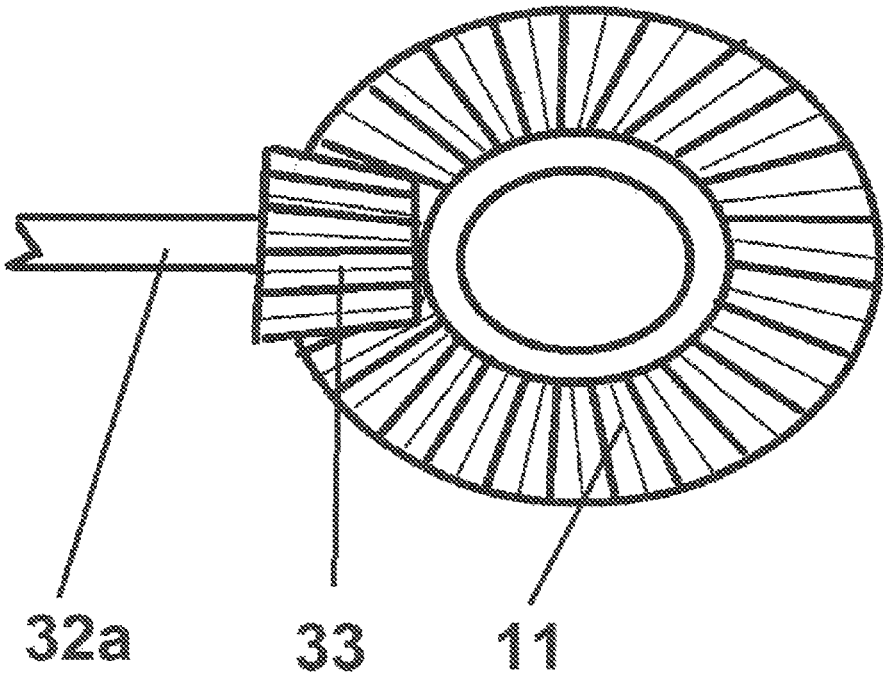
FIG. 2C is a top, view of a gearing portion of the embodiment of FIG. 1A.

Turning generally to FIGS. 2A-2C and at times remaining with FIG. 1A, several components and aspects of the invention are further depicted.

Turning to FIG. 2A, the central laminate layer 17*b* of a support arm is with the other laminate layers removed is shown.

When assembled, the outer layers of the support arms 12*a*, 12*b* enclose the drive shaft 32*b* and gear components. The inner laminate layer 17*b*, in this embodiment supports bearing carriers 48*b* for the drive shaft 32*b*. A drive shaft 32*b* and power transfer gear are also shown. With the layer 16B, 17B, 18B separated and other layers removed, it can be readily seen that the head shaft bearing carriage 62 and bearings can be more easily accessed and serviced.

Turning to FIGS. 2A and 2C, the drive shaft 32, for driving the cutting head is located within each support arm 12*a*, 12*b* and has a pinion gear 38 on one end to engage with the motor bevel gear (not shown here) and a drive shaft bevel gear 33 on the other end of the drive shaft 32*b* to engage the ring gear 11 of the head shaft 60.

Referring to FIG. 2*b*, a bearing carrier and bearings 62, and cat seal 50, located on each side of each support arm, and through which the head shaft 60 passes, are shown in further detail.

Referring to FIG. 2*c* and additionally back to FIGS. 1A and 2A, the ring gear 11 of the head shaft 60 and drive shaft bevel gear 33 are shown. The ring gear 11 is located at one side of and within a clearance milled in each support arm 12*a*, 12*b* and is keyed on the head shaft 60. The ring gear 11 of the cutting head shaft, is can be mechanically coupled to the motor through any suitable mechanical means in the art for such operation, typically via a gearing and shaft assembly. In this embodiment, as referenced in FIG. 2A the ring gear 11 engages the drive shaft bevel gear 33 which, in turn engages the pinion 36 The pinion gear, in turn, engages the motor bevel gear.

Rotational reduction of the drive shaft 32*b* is limited by this design, as it has limited reduction in rotational speed from the motor, and the only primary reduction is at the drive shaft bevel gear 33 and ring gear 11 interface of the cutting head, more cutting torque is provided. The laminate layers 16*b*, 17*b*, 18*b* can be milled or otherwise fabricated to provide any necessary clearance for the ring gear 11 the drive shaft bevel gear 33, the drive shaft 32*b* or other components. Accordingly, different components of varying sizes can be relatively easily adapted into the cutting head and support arm apparatus 2.

For example, a milled portion of the inner and center layers 17*a*, 17*b*, 18*a*, 18*b* of each support arm 12*a*, 12*b* can provide for mounting and clearance of motors and bevel gears. Further milled portions in the outer, central, and inner layers of each support arm provide any needed clearance for the pinion gear 36 and drive shaft 32*b*.

Disclosed herein is a modular cutting head and support apparatus, typically for use in highwall mining, for providing an apparatus capable of being maintained or repaired in less time with greater efficiency. These advantageous features and arrangement can reduce the time of component replacement or repair from up to several days to a few hours or less.

While the invention has been illustrated and described in detail in the foregoing drawings and description, the same is to be considered as illustrative and not restrictive in character, it being understood that only illustrative embodiments thereof have been shown and described and that all changes and modifications that come within the spirit and scope of the invention as defined in the claims and summary are desired to be protected.

It is to be understood that while certain forms of the present invention have been illustrated and described herein, the expression of these individual embodiments is for illustrative purposes and should not be seen as a limitation upon the scope of the invention. It is to be further understood that the invention is not to fee limited to the specific forms or arrangements of parts described and shown.

The invention claimed is:

1. A modular cutting head and support system for high wall mining, comprising:

a set of laminated support arms, and a cutting head apparatus, wherein the cutting head apparatus is further comprised of:

a central drum between two of the at least a pair of laminated support arms, a set of outer drums outside the set of laminated support arms relative to the central drum, a head shaft along at least the length of the central drum and along the lengths of the respective set of outer drums, and in an inner coaxial relationship with at least the central drum and set of outer drums, and wherein the head shaft is supported by the support arms, and wherein the set of laminated support arms are further comprised of a driving apparatus capable of driving the head shaft, at least three reversibly joined laminate layers, a support arm inner lamination layer, a support arm outer lamination layer, and at least one support arm center lamination layer, and a set of laminate attachment apparatus capable of reversibly joining the at least three reversibly joined laminate layers to each other.

2. A modular cutting head and support system according to claim 1, further comprising a set of cutting bits mounted or attached to the surface of the central drum and respective outer drums and wherein the cutting bits are arranged in a pattern capable of cutting when the system is in operation.

3. A modular cutting head and support system according to claim 2, wherein the cutting bits are arranged in a double V pattern.

4. A modular cutting head and support system according to claim 2, wherein the cutting bits are generally rounded and are each capable of axial movement.

5. A modular cutting head and support system according to claim 1, further comprising at least a pair of struts between the laminated support arms, are reversibly attached perpendicularly to the laminated support arms to support them, and are capable of maintaining a constant distance between the laminated support arms.

6. A modular cutting head and support system according to claim 5, wherein the at least a pair of struts are between the respective laminated support arms at designated intervals, and are comprised of 2-4 struts.

7. A modular cutting head and support system according to claim 5, wherein the at least a pair of struts are between the respective laminated support arms at designated intervals, and are comprised of S or more struts.

8. A modular cutting head and support system according to claim 1, wherein the central drum and outer drums are combined in s single piece construction.

9. A modular cutting head and support system according to claim 1, further comprising a set of outer drum heads at each respective end of each of the set of outer drums, and wherein the outer drum heads are attached to the respective outer drums, and are capable of securing apparatus within the outer drums.

10. A modular cutting head and support system according to claim 1, wherein the central and outer drums are each capable of containing a reservoir of lubrication.

11. A modular cutting head and support system according to claim 1, further comprising sets of head shaft bearings located, respectively, where the head shaft is supported by the set of laminated support arms.

12. A modular cutting head and support system according to claim 1, further comprising a set of bearing carrying and holding arrangements, located where the laminated support arms support the head shaft, and comprised of:

a shaft bearing carrier, shaft bearings, and a cat seal, together capable of reducing rotation friction of the head shaft when the support system is being operated.

13. A modular cutting head and support system according to claim 1 further comprising a set of bearing carrying and holding arrangements, wherein the set of bearing carrying and holding arrangements are each capable of sealing and holding lubricant.

14. A modular cutting head and support system according to claim 1, wherein the driving apparatus is further comprised of a drive mechanism and at least one respective drive shaft, capable of providing rotational power to the head shaft, connected to the drive mechanism.

15. A modular cutting head and support system according to claim 1, wherein the set of laminate attachment apparatus is comprised of a set of metal dowels, bolts, or screws, or any combination thereof, and a set of corresponding apertures through the laminate layers capable of accommodating the metal dowels, bolts, or screws.

16. A modular cutting head and support system according to claim 1, wherein the set of laminate attachment apparatus is comprised of a set of bolts, and a set of corresponding apertures through the laminate layers capable of accommodating the bolts.

17. A modular cutting head and support system according to claim 1 wherein at least one laminated support arm is comprised of a drive shaft, at least one drive shaft transfer gear for transferring power from a main shaft to the drive shaft, and at least one head shaft transfer gear to transfer power from the drive shaft to the head shaft.

18. A modular cutting head and support system according to claim 1, further comprising a top cover, a bottom cover or both, wherein the top cover, bottom cover or both are each attached to at least the set of laminated support arms.

19. A modular cutting head and support system according to claim 1, wherein each respective laminated support arm is further comprised of a hydraulic cylinder and at least one hinge, located at the end of the laminated support arm away from the central and outer drums, and capable of pivoting each respective laminated support arm upward or downward.

20. A modular cutting head and support system according to claim 1, further comprising a set of core breaker bits on the surface of the center drum, outer drum, or both at or near each respective support laminated arm, wherein the core breaker bits are capable of cutting material in front of each respective laminated support arm, and are capable of maintaining a minimal clearance from the laminated support arms.

* * * * *